US008250701B1

(12) United States Patent
Forsline et al.

(10) Patent No.: US 8,250,701 B1
(45) Date of Patent: Aug. 28, 2012

(54) APPLIANCES FOR ART AND CRAFT MEDIA AND THE LIKE

(75) Inventors: Ladd B. Forsline, Kutztown, PA (US); Susanna R. Starr, New York, NY (US)

(73) Assignee: Ladd Forsline, Kutztown, PA (US)

( * ) Notice: Subject to any disclaimer, the term of this patent is extended or adjusted under 35 U.S.C. 154(b) by 0 days.

(21) Appl. No.: 12/878,706

(22) Filed: Sep. 9, 2010

Related U.S. Application Data

(62) Division of application No. 11/074,989, filed on Mar. 8, 2005, now abandoned.

(60) Provisional application No. 60/551,377, filed on Mar. 9, 2004.

(51) Int. Cl.
*B44D 3/00* (2006.01)
*B05C 17/10* (2006.01)

(52) U.S. Cl. ..... 15/245.1; 15/114; 15/118; 15/168; 15/188; 15/209.1; 15/210.1; 15/244.1; 15/246; 15/247

(58) Field of Classification Search ..... 15/209.1, 15/210.1, 244.1, 246, 247, 114, 118, 168, 15/188, 245.1
See application file for complete search history.

(56) References Cited

U.S. PATENT DOCUMENTS

| | | | | | |
|---|---|---|---|---|---|
| 1,055,927 | A | | 3/1913 | Leighton | |
| 1,682,657 | A | | 8/1928 | Blank | |
| 1,694,636 | A | | 12/1928 | Barker | |
| 1,696,816 | A | | 12/1928 | Steinarson | |
| 1,791,218 | A | * | 2/1931 | Mallinckrodt | 15/210.1 |
| 2,062,065 | A | * | 11/1936 | Miley | 15/210.1 |
| 2,099,030 | A | | 11/1937 | Morrison | |
| 2,147,310 | A | | 2/1939 | Morrison | |
| 2,190,811 | A | * | 2/1940 | Van Zeeland | 15/235.4 |
| 2,269,424 | A | | 1/1942 | Bernstein | |
| 2,555,858 | A | | 6/1951 | Oleksy | |
| 2,602,947 | A | | 7/1952 | Soss | |
| 2,694,213 | A | | 11/1954 | Thomasson | |
| 2,703,424 | A | * | 3/1955 | Nicoli | 15/244.1 |
| 3,059,262 | A | * | 10/1962 | Marschner | 15/244.1 |
| 3,079,628 | A | * | 3/1963 | Wright | 401/204 |
| 3,105,263 | A | | 10/1963 | Ginter | |

(Continued)

FOREIGN PATENT DOCUMENTS

FR 2686809 * 8/1993

(Continued)

OTHER PUBLICATIONS

3M, *Scotchmate™ Thin Reclosable Fastener* SJ3506/07, 2 pages, 2002.

*Primary Examiner* — Mark Spisich
(74) *Attorney, Agent, or Firm* — Patterson Thuente Christensen Pedersen, P.A.

(57) ABSTRACT

Novel appliances for the application, distribution, manipulation and/or removal of different types of media, including art and craft media, may be removably attached to conventional and commonly-available tools, such as palette/painting knives, brushes with hair/filament tips, and other media manipulators such as those having a polymeric contacting surface on their working end. The appliances are adapted for superimposition over the media-engaging working-head formations of the tools, and have media-engaging characteristics which differ from the native media-engaging characteristics of the working-head formations of the tools. Tools to which such appliances are attached in accordance with the invention are also disclosed.

7 Claims, 6 Drawing Sheets

U.S. PATENT DOCUMENTS

| | | | | | |
|---|---|---|---|---|---|
| 3,134,124 | A | * | 5/1964 | Horn | 15/244.1 |
| 3,229,690 | A | | 1/1966 | Scholl | |
| 3,380,504 | A | | 4/1968 | Green | |
| 3,428,987 | A | | 2/1969 | Loston | |
| 3,633,234 | A | | 1/1972 | Henningsen | |
| 3,797,062 | A | | 3/1974 | LoCicero et al. | |
| 3,828,386 | A | | 8/1974 | Roth | |
| 4,209,865 | A | | 7/1980 | Kozlowski | |
| 4,574,415 | A | | 3/1986 | Vitonis | |
| 4,856,136 | A | | 8/1989 | Janssen | |
| 4,934,011 | A | | 6/1990 | Haug | |
| 4,971,126 | A | | 11/1990 | Borenstein | |
| 5,138,738 | A | | 8/1992 | Nicholson | |
| 5,177,831 | A | | 1/1993 | Wirth | |
| 5,318,171 | A | | 6/1994 | Szekely | |
| 5,320,531 | A | | 6/1994 | Delizo-Madamba | |
| 5,542,144 | A | | 8/1996 | Forsline | |
| 5,850,664 | A | | 12/1998 | Forsline | |
| 5,855,214 | A | | 1/1999 | Heneghan | |
| 5,887,310 | A | | 3/1999 | Wright | |
| 6,032,322 | A | | 3/2000 | Forsline | |
| 6,079,423 | A | | 6/2000 | Suzuki | |
| 6,240,592 | B1 | * | 6/2001 | Li | 15/244.3 |
| 6,308,371 | B1 | | 10/2001 | Forsline | |
| 6,647,549 | B2 | | 11/2003 | McDevitt et al. | |
| 6,721,987 | B2 | | 4/2004 | McDevitt et al. | |
| 2001/0044982 | A1 | * | 11/2001 | Ribar | 15/210.1 |
| 2002/0143281 | A1 | | 10/2002 | Wiley | |
| 2004/0074033 | A1 | | 4/2004 | Steinberg | |
| 2004/0168700 | A1 | | 9/2004 | Dorf | |
| 2004/0177863 | A1 | | 9/2004 | McKay | |
| 2004/0250840 | A1 | | 12/2004 | Baker et al. | |

FOREIGN PATENT DOCUMENTS

| | | | |
|---|---|---|---|
| GB | 1 230 983 | | 5/1971 |
| WO | WO 85/02523 | | 6/1985 |
| WO | 2004/105962 | * | 12/2004 |

* cited by examiner

FIG.4
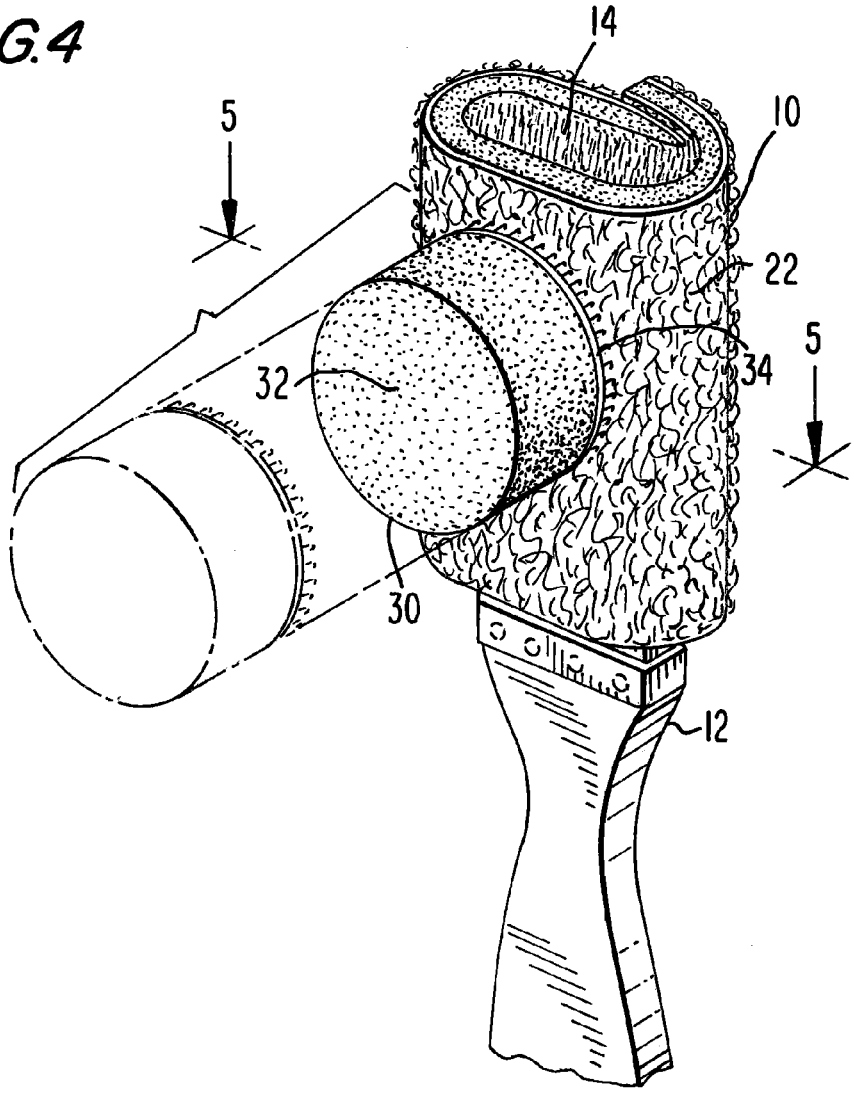
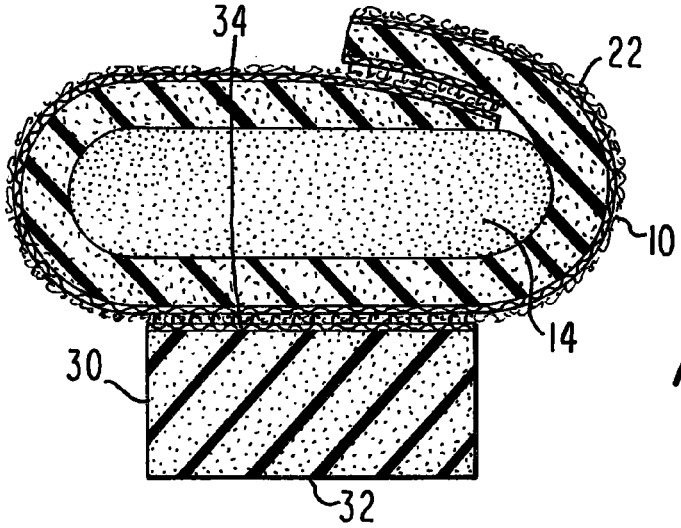
FIG.5

FIG. 6
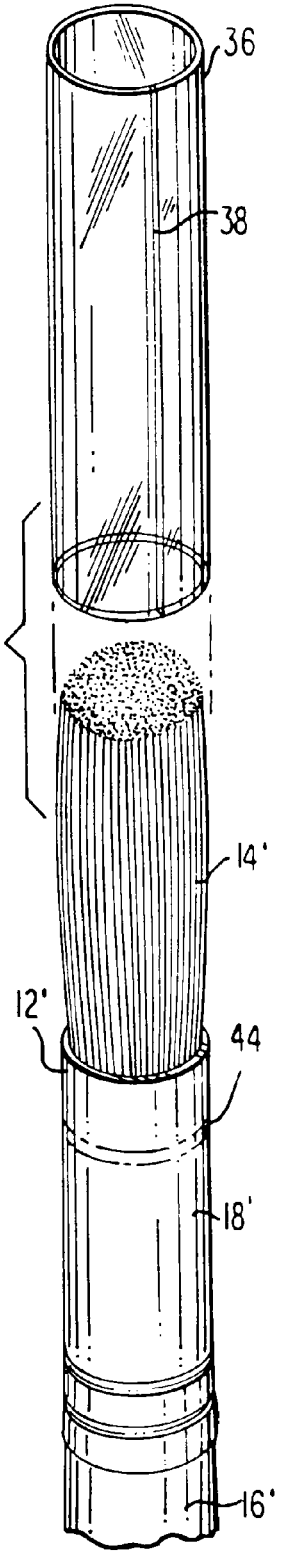
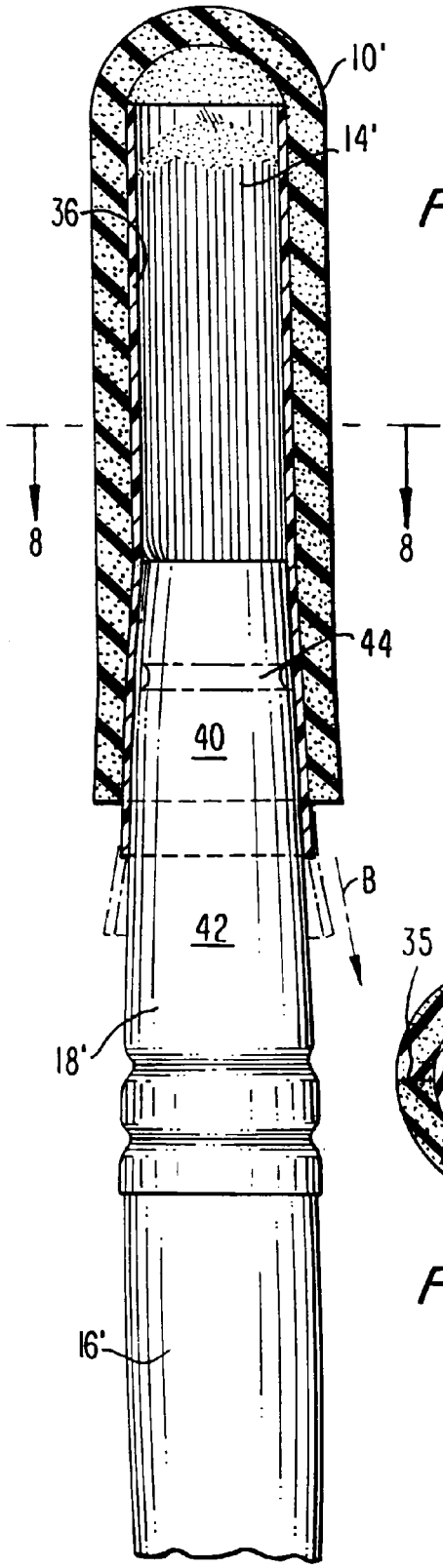
FIG. 7
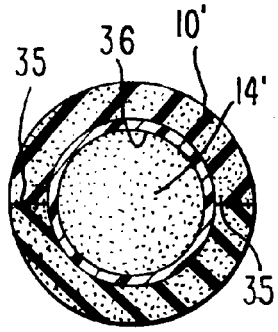
FIG. 8

52
50
10
10
47
54
49
46
48

52
52
50
47

62
57
56

64
59
58

66
61
60

FIG.14
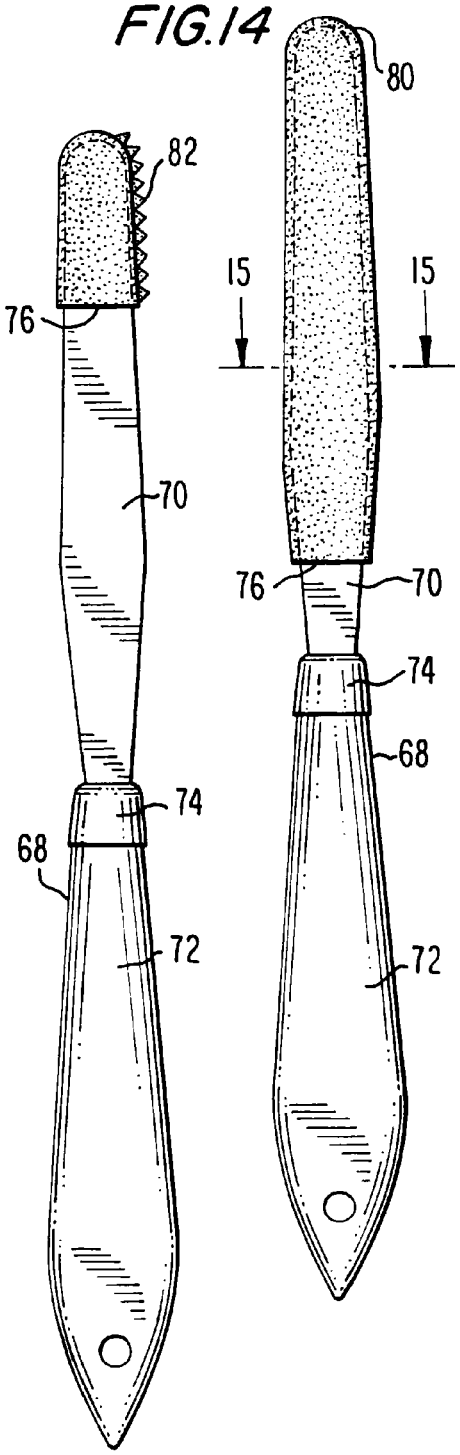
FIG.16
FIG.15
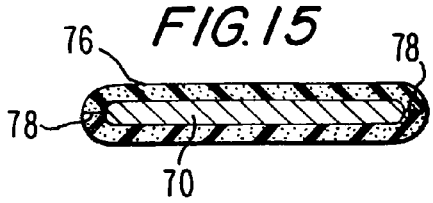
FIG.17
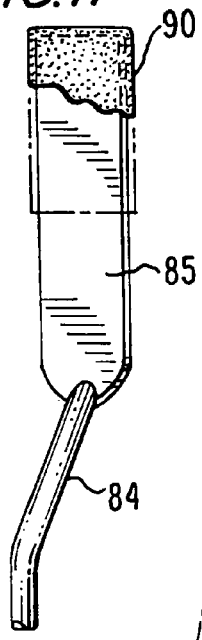
FIG.18
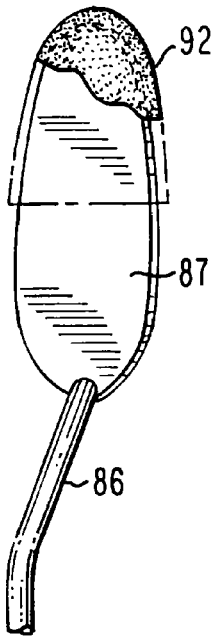
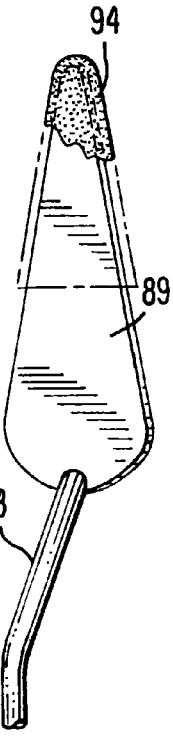
FIG.19

APPLIANCES FOR ART AND CRAFT MEDIA AND THE LIKE

RELATED APPLICATION

This application is a division of application Ser. No. 11/074,989 filed Mar. 8, 2005, abandoned, which claims the benefit of U.S. Provisional Application No. 60/551,377 filed Mar. 9, 2004, each of which is hereby fully incorporated herein by reference.

TECHNICAL FIELD

The present invention relates to the field of devices for the application, distribution, manipulation and/or removal of different types of media, including art and craft media such as paints, inks, glues, clays, slips, glazes, grout, pastel, charcoal, polymer-based materials and sealants, by artists, craftsperson, hobbyists and home decorating enthusiasts, as well as dental and cosmetic technicians and others. In particular, the present invention relates to appliances which may be attached to conventional and commonly-available tools, such as palette knives, paint and cosmetic brushes with natural hair or synthetic filaments, and other media applicators/manipulators such as those having polymeric contacting surfaces on their working ends. The present invention also relates to improved tools bearing such appliances.

BACKGROUND OF THE INVENTION

Since prehistoric times, artists have applied and manipulated paint on substrates. Very early artists might have used their bare hands and fingers, as do children and even artists today, but the use of tools for painting became common very early. Some of the earliest of such tools were likely mere sticks. However, brushes have been known and in use for much of modern history. Traditionally, the bristles, which form the media-engaging working-head formation of such brushes, were formed from natural materials such as the hair of animals, although with the development of modern synthetic plastics, artificial filaments have become available; typically, the hairs/filaments are attached via a ferrule to a wooden handle. Brushes have similarly been used for hundreds of years in the application of cosmetics or make-up to the skin of the human body, particularly the skin of the face.

While hair/filament brushes are widely used, and are extremely versatile, especially since they are nowadays available in a wide variety of sizes and shapes and with varying granularity and coarseness of the hairs/filaments, enabling the production of a seemingly unlimited assortment of marks and brush stroke textures, there is, nevertheless, a need for a brush-type tool which is more universal in its application characteristics, so that such a tool may be used, for example, to blend and smudge powdery soft pastel materials, which the coarse boar bristles of a conventional oil painting brush are not ordinarily able to catch and hold.

Besides hair/filament brushes, alternative tools and implements have been developed to assist artists, craftsperson, hobbyists and others in the application and manipulation of paint and other media. Perhaps the most well-known among these are painting and palette knives, which although developed more recently than brushes, have nevertheless been known, and have remained virtually unchanged, for hundreds of years. These implements are used to scrape, mix, apply and manipulate paint and other traditional media, including glues, grouts and clays, either on a palette or directly on a canvas or other work surface. Traditional painting and palette knives generally resemble small trowels, and consist of a flexible metal blade attached to a handle (which is typically wooden); the blade, which forms the media-engaging working-head formation of these implements, may be formed in a variety of shapes, including round, pear-shaped, diamond-shaped, straight-sided, and hybrid shapes. More recently, such tools have also been fabricated entirely of plastic.

Although these knives are useful, and they provide some advantages over traditional hair/filament brushes in terms of longevity and cleaning, their usefulness is limited because these tools typically have a more limited range of marks and manners of applying. media to a surface; in other words, it is difficult to paint with a hard (albeit flexible), non-absorbent blade that is primarily a flat, two-dimensional surface. The texture that can be created by using such a knife is very specific, because the flat, two-dimensional shape effectively limits the manner in which these tools can be used to produce trowel-like strokes. In addition, these knives are useful almost exclusively for applying and manipulating only thick, viscous media having a consistency resembling that of soft paste, such as the "impasto" forms of paint; these knives are almost useless to apply dry media, such as soft pastels. These well-known undesirable characteristics of traditional painting and palette knives deter many artists, craftspersons and hobbyists from using them.

Recently, still other tools with which artists, craftspersons, hobbyists, and others may apply and manipulate paint and other media have been developed, such as the specialized tools described in U.S. Pat. Nos. 5,542,144, 5,689,872, 5,749,117, 5,850,664, 6,032,322, 6,308,371 and 6,319,004. These painting, drawing, craft and dental tools consist of cylindrical handle formed of wood, plastic or metal, to which a molded silicone rubber "tip," which forms the media-engaging working-head formation of these implements, is attached via a ferrule. The silicone rubber formations are flexible yet durable, and are nonabsorbent and non-stick (and therefore easy to clean), which makes them ideal for use by artists, craftsperson, hobbyists and dental technicians for applying, manipulating and removing a wide variety of art and craft media, including paints, pastels, charcoal, pencil, clays, adhesives, sealants and other polymer-based materials. These tools are currently marketed and sold under the trademark COLOUR SHAPER, and they are available with a variety of useful, differently-shaped working-head formations, including conical taper point, as well as flat chisel, angle chisel, cupped round, and cupped chisel configurations.

Despite their advantages, however, these new tools cannot be used in the application of certain media. Indeed, it is the very same non-absorbent, nonstick characteristics of their working-head formations which make these tools so ideal for use with other media, that also make them less than ideal for use with dry media, such as soft pastels, and low-viscosity media, such as certain inks as well as watercolor forms of paint.

Accordingly, there is a need to improve existing art and craft tools so that each can be used to apply, distribute, manipulate and/or remove a wider variety of media, including dry drawing media, and so that each can be used to create a wider variety of marks and textures with those media, all ideally without permanently surrendering the beneficial existing characteristics of their native media-engaging working-head formations; it is the principal object of the present invention to provide such an improvement.

In addition, it is another objective of the present invention to provide a modification of the presently existing art and craft tools so as to allow them to be used in the application and manipulation of certain novel color compositions which have recently been developed by the present inventors and as to which separate patent applications are presently pending.

SUMMARY OF THE INVENTION

The objects and advantages of the present invention are achieved by providing a selection of media-engaging appliances, having common characteristics, which may be removably attached to the working ends of the conventional and commonly-available tools described hereinabove, thereby temporarily changing the attributes of their media-engaging working-head formations and resulting in an expansion of their usefulness by allowing them to be used to apply and manipulate surface coatings and other media for which they are not otherwise ordinarily suited. The appliances can be manufactured from a variety of materials, and can be made either disposable after one use or reusable. Optionally, the appliances may include a lining consisting of a material that is relatively impermeable to the transmission of fluids, so as to prevent contact between the native media-engaging working-head formations of the underlying tools and the media with which a particular appliance is in contact.

The shape of each appliance generally conforms to the shape of the working-head formation of the underlying tool to which it is attached, and most of the appliances are sized so that each one is slightly smaller than the media-engaging working-head formation of the underlying tool allowing the appliance to be attached to the tool via a friction fit. If desired, a crimp or groove can be molded into or formed in the blade, head or ferrule area of the underlying tool, providing additional mechanical friction and also providing a visual reference for positioning the appliance. The present invention encompasses not only the appliances themselves, but also the underlying tools as modified by such an appliance.

BRIEF DESCRIPTION OF THE DRAWINGS

These and other aspects, features, objects and advantages of the present invention will become more apparent from the following detailed description of the presently most preferred embodiments thereof (which are given for the purposes of disclosure), when read in conjunction with the accompanying drawings (which form a part of the specification, but which are not to be considered limiting in its scope), wherein:

FIG. 4 is an exploded perspective view, partially in phantom, of yet another aspect of the embodiment shown in FIG. 1;

FIG. 5 is a cross-sectional view, taken substantially along the lines 5-5 of FIG. 4;

FIG. 6 is an exploded perspective view, partially in phantom, illustrating another preferred embodiment of the present invention;

FIG. 7 is an enlarged plan view, partially in cross-section and partially in phantom, of the embodiment shown in FIG. 6;

FIG. 8 is a cross-sectional taken substantially along the lines 8-8 of FIG. 7;

FIG. 14 is a plan view, partially in phantom, illustrating one aspect of still another preferred embodiment of the present invention;

FIG. 15 is a cross-sectional view, taken substantially along the lines 15-15 of FIG. 14;

FIG. 16 is a plan view, partially in phantom, illustrating another aspect of the embodiment shown in FIG. 14;

FIGS. 17-19 are truncated perspective views, partially in cross-section, of still other aspects of the embodiment shown in FIG. 14;

DETAILED DESCRIPTION OF THE PREFERRED EMBODIMENTS

Figure 1:
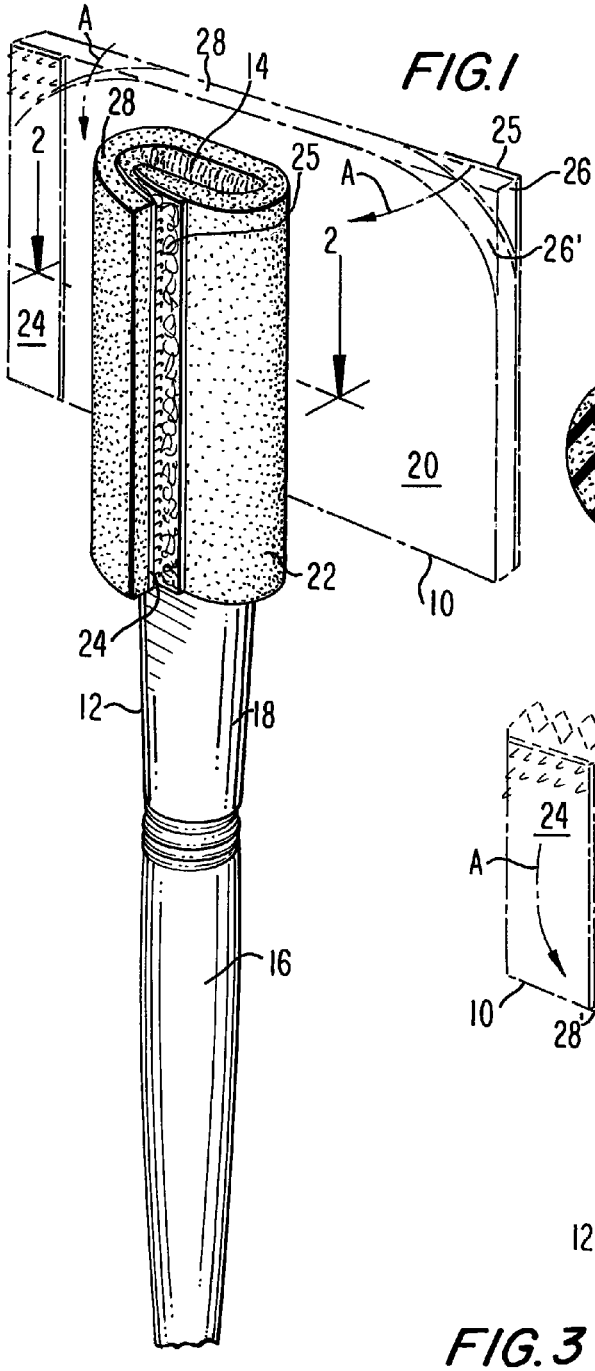
FIG. 1 is a an exploded perspective view, partially in phantom, illustrating one aspect of a preferred embodiment of the present invention.
Figure 2:
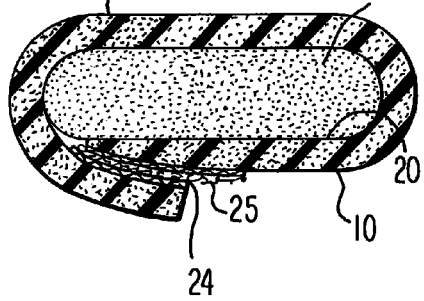
FIG. 2 is a cross-sectional view, taken substantially along the lines 2-2 of FIG. 1.
Figure 3:
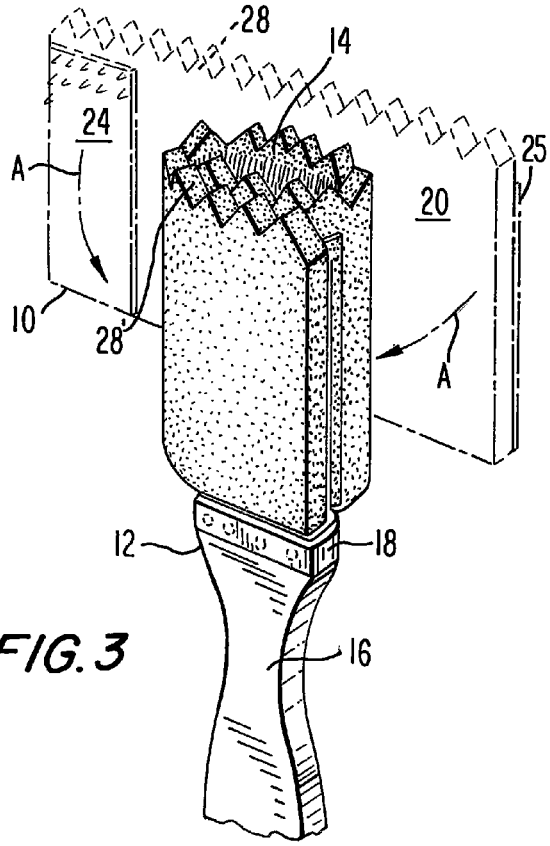
FIG. 3 is a perspective view similar to FIG. 1, but illustrating another aspect of the embodiment shown in FIG. 1.

The preferred embodiments of the present invention will now be further described with reference to the accompanying drawings, wherein like reference numerals designate like or corresponding parts throughout the several views. An appliance for use with conventional art, craft, cosmetic and general-use hair/filament brushes in accordance with a first preferred embodiment of the present invention is illustrated in FIGS. 1-8. Referring first to FIGS. 1-3, which depict a first aspect of this embodiment, an appliance 10 is illustrated for use with brushes in which the media-engaging working-head formation consists of a wide but relatively flat hair/filament configuration. Appliance 10 is removably attachable to a brush 12, the latter comprising an elongated shaft with a multiplicity of hairs/filaments 14 attached to a handle 16 via a ferrule 18 in a conventional fashion. As shown best in FIGS. 1 and 3, appliance 10 is generally planar and rectangular in shape, having a first inner surface 20 and a second outer surface 22, and is adapted to surround the media-engaging working-head formation of brush 12.

Appliance 10 may be manufactured from a variety of materials, including open or closed cellular foams, flocked sponges or foams, synthetic or natural non-foam polymeric materials, synthetic or natural hides, micro fibers, woven or non-woven fibrous materials, or a combination of two or more of the foregoing materials laminated together. Preferably, a cellular foam is used, which may be formed from natural or synthetic polymers. Preferred polymers for use in this invention are elastomeric polymers, although other non-elastomeric polymers, such as certain polyurethanes and homopolymers of styrene, acrylonitrile, vinyl acetate, alkyl acrylates (such as ethyl acrylate), alkyl methacrylates (such as methyl methacrylate), vinyl chloride, vinylidene chloride and vinyl butyral, as well as copolymers of these materials with other polymeric materials such as ethylene, can also be used. Elastomeric polymers, which are defined by ASTM as materials that can be stretched at room temperature to twice their length, held for 5 minutes, and upon release will return to within 10 percent of their original length over a similar period of time, include such polymers as natural rubber, isoprene rubber, butadiene rubber, chloroprene rubber, isobutylene-isoprene rubber, nitrile-butadiene rubber, styrene butadiene rubber, ethylene-propylene copolymers ethylene-propylene-diene terpolymers, silicones, fluoroelastomers, polyacrylates, polyurethanes including polyethers (such as polyepichlorohydrin) and polyesters, chlorosulfonated polyethylene, chlorinated polyethylene, ethylene-acrylic copolymers, polypropylene oxide, thermoplastic elastomers, and thermoplastic resins.

If appliance 10 is to be made disposable, then the most preferred material is a polyurethane foam such as that available from Foamex of Philadelphia, Pa. On the other hand, if appliance 10 is to be made reusable, then the most preferred materials are a nitrile butadiene rubber or a styrene butadiene rubber, such as those available from Zeon Chemicals LP of Tokyo, Japan. Preferably, the thickness of appliance 10 ranges from approximately 0.01 inches to approximately 0.75 inches.

In this aspect, appliance 10 also includes self-attaching fastener means, which preferably comprises a conventional hook-and-loop reclosable fastening system in which the hook structures are illustratively disposed on a portion 24 of inner surface 20 of appliance 10, and the loop structures are illustratively disposed on a portion 25 of outer surface 22 of appliance 10. Although suitable hook-and-loop fastening systems are available commercially from several different manufacturers, the one sold under the trademark SCOTCH MATE and identified as Thin Reclosable Fastener SJ3506/07, available from 3M Company of St. Paul, Minn., is preferred.

As shown in FIGS. 1-3, appliance 10 may be wrapped around the hairs/filaments 14 of brush 12, in the direction indicated by the arrows A in FIGS. 1 and 3, following which appliance 10 may be fastened into position, with the hook structures of portion 24 engaging the loop structures of portion 25, as shown best in FIG. 2. Appliance 10 thereby encircles and encloses the hairs/filaments 14 of brush 12, and temporarily provides an alternative media engaging working-head formation which eliminates the texture of the brush stroke, thus changing the working attributes of brush 12 and expanding its media range beyond paint by allowing it to be used to apply and manipulate dry media (e.g., to blend and smudge soft pastels on a paper surface, for which conventional brushes are not otherwise ordinarily suited), while still maintaining the bounce and flexibility characteristics normally associated with a brush. At any time after such use, appliance 10 may be removed by detaching the hook structures from the loop structures, thereby allowing the hairs/filaments 14 to be used once again in the usual fashion, thus restoring the native media-engaging working-head formation of brush 12.

As shown in FIG. 1, appliance 10 may be manufactured in a true rectangular shape, in which each of the corners 26 describes substantially a right angle, or in a shape in which two of the corners 26' are somewhat rounded. Also, appliance 10 may optionally be manufactured with a flat leading edge 28, as shown in FIGS. 1 and 2, or with a serrated leading edge 28', as shown in FIG. 3, or with a pillowed edge, as described more fully hereinbelow in connection with FIGS. 20-21. It will be evident to those skilled in the art that by varying the shape of the corners and/or the shape of the leading edge of appliance 10, the user is provided with the ability to make a variety of different marks with a given medium for which conventional brushes are not otherwise ordinarily suited.

FIGS. 4 and 5 illustrate a variation of the aspect of FIGS. 1-3, in which the user is provided with the ability to make even a wider variety of marks with appliance 10 attached to brush 12. Specifically, instead of the loop structures being disposed on only a portion of the outer surface 22 of appliance 10, they are disposed on the entire outer surface 22. In addition, an appliance extension 30 is provided, which is fabricated of the same material as appliance 10, and which has a media-engaging surface 32 and an opposed attachment surface 34 on which hook structures are disposed. Extension 30 may be fastened into position on appliance 10 with the loop structures of outer surface 22 engaging the hook structures disposed on surface 34. Although extension 30 is illustratively shown in the drawings as being cylindrical in shape, it is to be understood that extension 30 may be manufactured in many other shapes, according to the user's needs.

Referring now to FIGS. 6-8 in addition to the aforementioned FIGS. 1-5, a different aspect of the first preferred embodiment of the present invention is illustrated, specifically, an appliance 10' for use with brushes in which the media-engaging working-head formation consists of a circular hair/filament configuration. In this aspect, appliance 10' may be manufactured from the same materials and in the same thicknesses as specified hereinabove for appliance 10, although unlike appliance 10, appliance 10' preferably comprises two sheets of such materials that are then sewn or glued, or are bonded together via heat sealing or ultrasonic sealing or the like, to form a thimble-like enclosure with an open end and a closed end, as shown best in cross-section in FIG. 7, but with side seams 35, as shown best in FIG. 8. Furthermore, unlike appliance 10, appliance 10' does not require hook-and-loop structures in order to be fastened properly in place over a brush.

In this aspect, appliance 10' is removably attachable to a brush 12', the latter comprising an elongate shaft with a multiplicity of hairs/filaments 14' attached in a conventional fashion to a handle 16' via a tapered ferrule 18'. Preferably, appliance 10' is attachable to brush 12' with the aid of an inner sleeve 36, which may be fabricated from any suitably smooth but rigid plastic or paper material, and which is used to protect and maintain the shape of the hairs/filaments 14'. As shown best in FIG. 6, inner sleeve 36, which includes a longitudinal expansion, slit 38, is first positioned on brush 12' such that it surrounds hairs/filaments 14' and also surrounds the narrower portion 40 of ferrule 18' that is adjacent to hairs/filaments 14', as shown in FIG. 7. Appliance 10' may then be positioned on brush 12' by sliding it over inner sleeve 36, following which inner sleeve 36 may be removed in the direction indicated by arrow B in FIG. 7, by sliding it first over the wider portion 42 of ferrule 18' and then over handle 16', with slit 38 (not shown in FIG. 7) expanding in a known fashion to permit such movement.

Appliance 10' thereafter encircles and encloses the hairs/filaments 14' of brush 12', and temporarily provides an alternative media-engaging working-head formation which eliminates the texture of the brush stroke, thus changing the working attributes of brush 12' and expanding its media range beyond paint by allowing it to be used to apply and manipulate dry media (e.g., soft pastels, for which conventional brushes are not otherwise ordinarily suited), while still maintaining the bounce and flexibility characteristics normally associated with a brush. Although inner sleeve 36 may alternatively be left in place after appliance 10' is positioned on brush 12', and may even be retained there while the brush is being used, it is to be understood that some of the bounce and flexibility characteristics normally associated with the brush will consequently be lost.

It will be evident to those skilled in the art that appliance 10' may be manufactured to fit brushes 12' with differing hair/filament sizes and shapes, with appliance 10' being sized slightly smaller than the brush head itself in order to provide a friction fit. If desired, ferrule 18' can be formed with an additional crimp or groove 44 (shown for illustrative purposes in phantom in FIGS. 6 and 7), providing additional mechanical friction and also providing a visual reference for the proper positioning of appliance 10'.

Referring now to FIGS. 9-13 of the drawings, additional appliances in accordance with a second preferred embodiment of the present invention are illustrated for use with a group of patented painting, drawing, craft and dental tools having molded silicone rubber tips. As mentioned hereinabove, these tools are currently marketed and sold under the trademark COLOUR SHAPER, and they are available in several different sizes and levels of firmness, with a variety of useful, differently-shaped media-engaging working-head formations. For illustrative purposes, four of these working-head formations are depicted in FIGS. 9 and 11-13, and these tools will be referred to hereinafter as "shaper tools."

Figure 9:
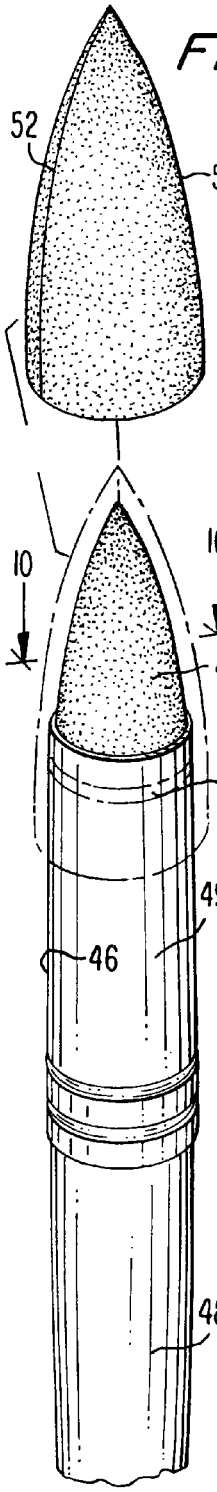
FIG. 9 is an exploded perspective view, partially in phantom, illustrating one aspect of yet another preferred embodiment of the present invention.
Figure 10:
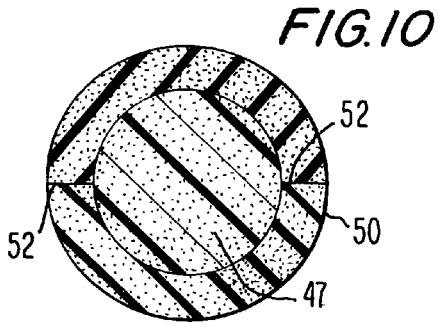
FIG. 10 is a cross-sectional view, taken substantially along the lines 10-10 of FIG. 9.

Referring first to FIG. 9, a shaper tool 46, comprising an elongate shaft having a media-engaging working-head formation consisting of a silicone rubber tip configured as a conical taper point 47, which is attached in a conventional fashion to a handle 48 via a ferrule 49, is provided with an appliance 50 in accordance with a first aspect of this embodiment of the invention. Appliance 50 may be manufactured from the same materials and in the same thicknesses as specified hereinabove for appliances 10 and 10', although natural hides are difficult to use and therefore are not preferred. Like appliance 10', appliance 50 preferably comprises two sheets of such materials that are then bonded together to form a thimble-like enclosure with an open end and a closed end, with side seams 52, as shown best in cross-section in FIG. 10. Appliance 50 has a conical taper point shape, so as to conform to the shape of the working-head formation of the shaper tool 46 to which it will be attached, and as shown in phantom in FIG. 9, appliance 50 may be positioned on shaper tool 46 by sliding it over conical taper point 47.

It will be evident to those skilled in the art that appliance 50 will preferably be sized slightly smaller than conical taper point 47 in order to provide a friction fit. If desired, ferrule 49 can be formed with an additional crimp or groove 54 (shown for illustrative purposes in phantom in FIG. 9), providing additional mechanical friction and also providing a visual reference for the proper positioning of appliance 50.

Figure 11:
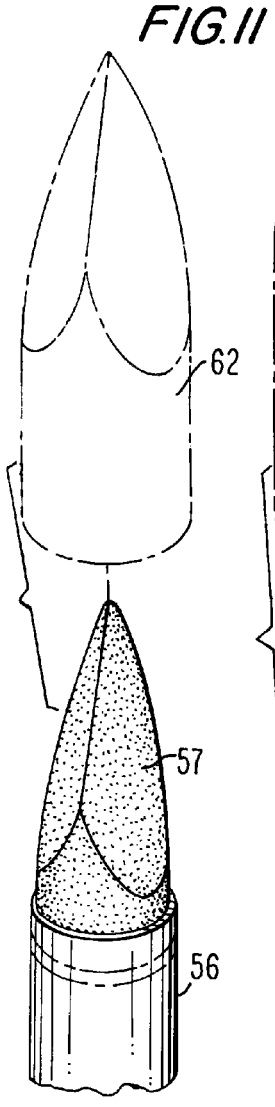
FIGS. 11-13 are truncated exploded perspective views, partially in phantom, illustrating additional aspects of the embodiment shown in FIG. 9.
Figure 12:
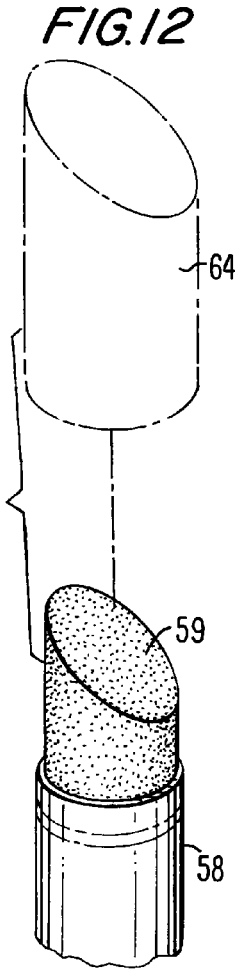
Figure 13:
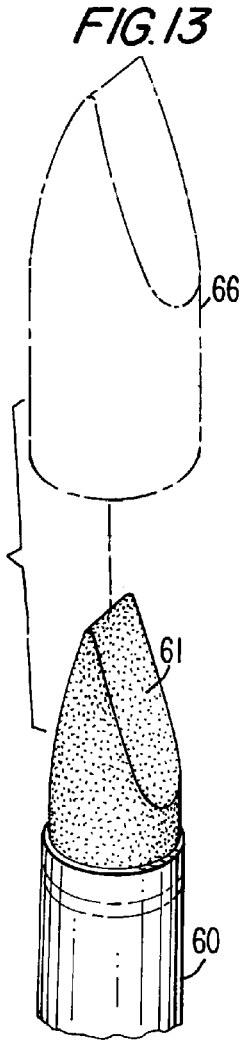

FIGS. 11-13 respectively depict shaper tools 56, 58 and 60, having media-engaging working-head formations comprising silicone rubber tips configured, respectively, in an angle chisel configuration 57, a cupped round configuration 59, and a flat chisel configuration 61. In accordance with additional aspects of this second preferred embodiment of the invention, appliances 62, 64 and 66 are provided for use with these shaper tools, as shown in phantom, respectively, in FIGS. 11-13. As will be evident from the drawings, appliance 62 has an angle chisel shape, while appliance 64 has a cupped round shape and appliance 66 has a flat chisel shape, so that each of these appliances will conform to the shape of the working-head formation of the respective shaper tool 56, 58 and 60 to which it will be attached. Except for their shapes, each of appliances 62, 64 and 66 is otherwise identical, in its manufacture and manner of use, to appliance 50.

As will be evident, appliances 50, 62, 64 and 66 encircle and enclose the silicone rubber tips of the shaper tools to which they are attached, and temporarily provide an alternative media-engaging working-head formation which modifies the working properties and characteristics of those tools and expands their media range. For example, if appliances 50, 62, 64 or 66 are fabricated of an absorbent material, then the shaper tools can be used to apply and manipulate media of low viscosity, such as certain inks and watercolor-type paints, for which the nonabsorbent silicone rubber tips of these tools are not otherwise ordinarily suited. At any time after such use, however, these appliances may be removed, thereby allowing the molded silicone rubber tips to be used once again in the usual fashion, thus restoring the native media-engaging working-head formations of shaper tools 46, 56, 58 and 60.

Referring now to FIGS. 14-21 of the drawings, additional appliances in accordance with a third preferred embodiment of the present invention are illustrated for use with painting and palette knives, which are conventional art, craft and hobbyist tools that are available in an enormous variety of configurations, sizes and blade shapes, a few examples of which are depicted in FIGS. 14 and 17-20. As mentioned hereinabove, traditional painting and palette knives generally resemble small trowels, consisting of a flexible metal or plastic blade (which constitutes the media-engaging working-head formation) attached to a handle, and they are used to scrape, mix, apply and manipulate paint and other traditional media, including glues, grouts and clays, either on a palette or directly on a canvas or other work surface.

Referring first to FIGS. 14-16, a palette knife 68, comprising an elongate shaft having a blade 70 as the media-engaging working-head formation, which is attached in a conventional fashion to a handle 72 via a ferrule 74, is provided with an appliance 76 in accordance with a first aspect of this embodiment of the invention. Appliance 76 may be manufactured from the same materials and in the same thicknesses as specified hereinabove for appliances 10 and 10', and like appliance 10', appliance 76 preferably comprises two sheets of such materials that are then bonded together to form an enclosure with an open end and a closed end, with side seams 78, as shown best in cross-section in FIG. 15. Appliance 76 can be manufactured either so as to enclose substantially all of blade 70, as shown in FIG. 14, or so as to enclose only a small portion of blade 70, as shown in FIG. 16. In either case, appliance 76 is manufactured in a shape which corresponds to the shape of blade 70. Also, appliance 76 may optionally be manufactured with a completely flat edge 80, as shown in FIG. 14, or with a partially serrated edge 82, as shown in FIG. 16, or with other edge configurations according to the user's needs. Appliance 70 may be positioned on palette knife 68 by sliding it over the end of blade 70, as shown in FIGS. 14 and 16; preferably, appliance 76 will be sized slightly smaller than blade 70 in order to provide a friction fit.

FIGS. 17-19 respectively depict other exemplary palette and painting knife tools 84, 86 and 88, having elongated handles and having media-engaging working-head formations comprising, respectively, a rectangular-shaped blade 85, an oval-shaped blade 87 and a pear-shaped blade 89. In accordance with additional aspects of this third preferred embodiment of the invention, appliances 90, 92 and 94 are provided for use with these tools, as shown in phantom, respectively, in FIGS. 17-19. As will be evident from the drawings, appliance 90 has a rectangular shape, while appliance 92 has an oval shape and appliance 94 has a pear shape, so that each of these appliances will conform to the shape of the working-head formation of the respective tool 84, 86 and 88 to which it will be attached. Except for their shapes, each of appliances 90, 92 and 94 is otherwise identical, in its manufacture and manner of use, to appliance 76.

As will be evident, appliances 76, 90, 92 and 94 encircle and enclose, either in whole or in part, the blades of the tools to which they are attached, and temporarily provide an alternative media-engaging working-head formation which modifies the working properties and characteristics of those tools and expands their media range, essentially converting them into universal painting and drawing tools capable of applying, manipulating and removing a wide variety of media ranging in consistency from a thick oil color paint to a thin ink or watercolor paint, the latter being media for which the blades of these tools are not otherwise ordinarily suited. In addition, these appliances expand the media range of painting and palette knives by allowing them to be used to apply and manipulate (e.g., to mix, blend and smudge) dry media, procedures which are messy and dusty, and for which conventional palette knife blades are also not otherwise ordinarily suited, while still maintaining the cleanliness of the hands of the user, a characteristic normally associated with a palette knife. Thus, palette knives bearing the appliances of the present invention can be used as alternatives to the traditional artists' stumps and tortillons, and provide the user with virtually limitless possibilities for making marks and new surface textures. At any time after use, however, these appliances may be removed, thereby allowing the palette knife blades to be used once again in the usual fashion, thus restoring the native media-engaging working-head formations of tools 72, 84, 86 and 88.

Figures 20, 21, 22:
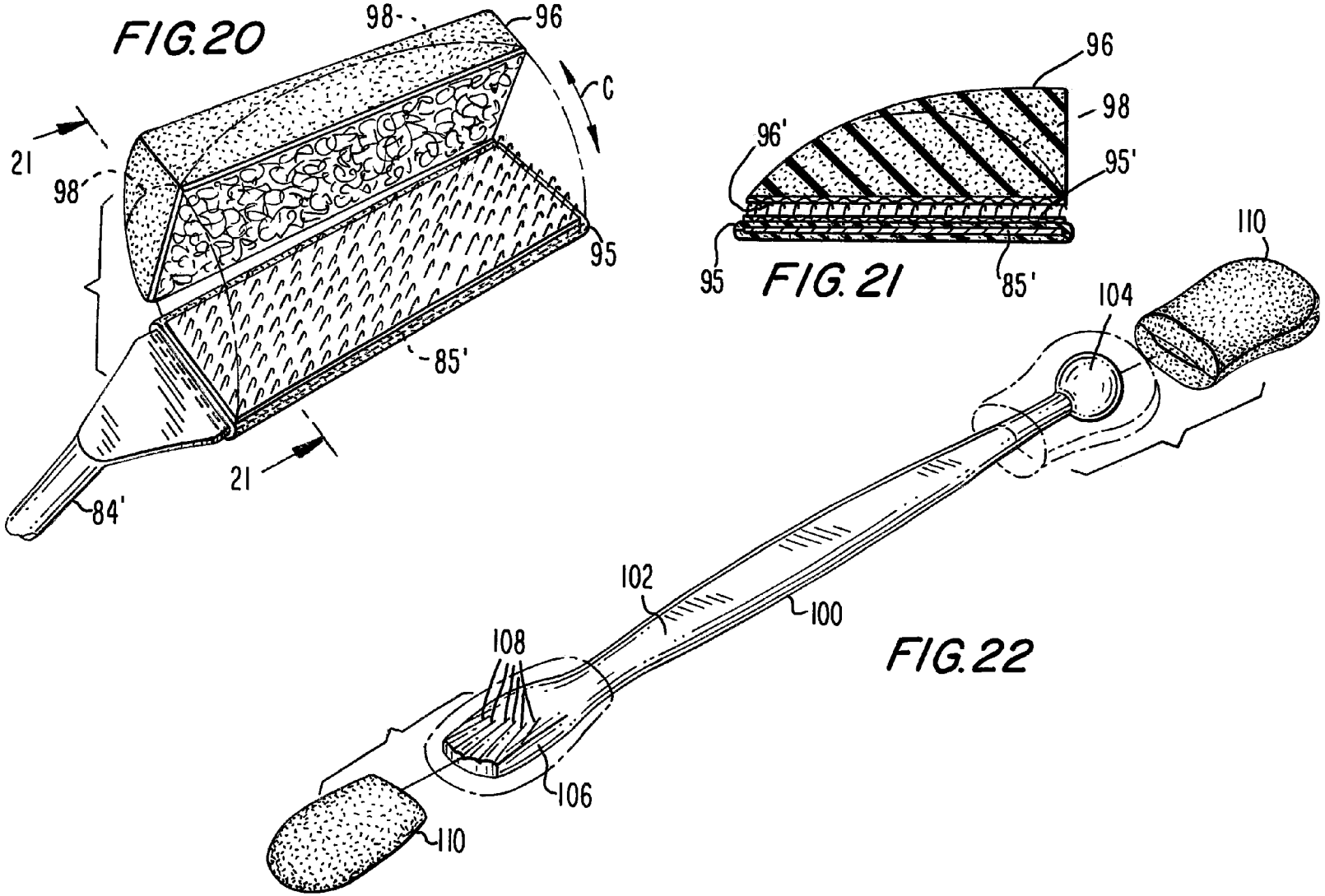
FIG. 20 is an enlarged, exploded perspective view illustrating yet another aspect of the embodiment shown in FIG. 14.
FIG. 21 is an enlarged partial cross-sectional view, partially in phantom, taken substantially along the lines 21-21 of FIG. 20.
FIG. 22 is an exploded perspective view, partially in phantom, illustrating still a further embodiment of the present invention.

FIGS. 20 and 21 illustrate an optional variation of this third preferred embodiment of the invention, shown illustratively as a variation of the aspect of FIG. 17, but which those of ordinary skill will understand as being applicable equally to any of the other aspects of this embodiment, as disclosed hereinabove. In this variation, the user is provided with the ability to make even a wider variety of marks with an appliance attached to a palette knife. In particular, an appliance 95, which may be manufactured from the same materials as specified hereinabove for appliances 10 and 10', may be attached to the blade 85' of palette knife 84' via a friction fit over the end of the blade, as disclosed in connection with FIGS. 14-19. However, in this variation an appliance extension 96 is provided, and a hook-and-loop fastener system, such as that disclosed hereinabove, is used to attach appliance extension 96 to appliance 95. Specifically, hook structures are disposed on at least one surface 95' of appliance 95, and loop structures are disposed on at least one surface 96' of appliance extension 96. As shown in FIG. 20, appliance extension 96 may be moved into proximity with the blade 85, in the direction indicated by the arrows C, following which appliance extension 96 may be fastened into position, with the hook structures on surface 95' of appliance 95 engaging the loop structures on surface 96' of appliance extension 96. In this variation appliance extension 96 may be manufactured with at least one rounded, pillow-shaped edge 98, or it may be manufactured with additional pillow-shaped edges, according to the user's needs, as shown by the phantom lines in FIGS. 20 and 21.

FIG. 22 depicts yet a fourth preferred embodiment of the present invention, wherein appliances are provided to alter the characteristics of the media-engaging working-head formations of conventional modeling tools utilized by artists, hobbyists and craftsperson to manipulate clay and other semi-solid media. As shown in FIG. 22, a typical modeling tool 100 has an elongate shaft 102, with a ball-shaped media-engaging working-head formation 104 disposed at one end of shaft 102, and a flat media-engaging working-head formation 106 disposed at the other end of shaft 102, with formation 106 typically carrying grooves 108. In accordance with this embodiment of the invention, tool 100 is provided with one or more appliances 110, each of which may be manufactured from the same materials and in the same thicknesses as specified hereinabove for appliances 10 and 10', and like appliance 10', each of appliances 110 preferably comprises two sheets of such materials that are then bonded together to form an enclosure with an open end and a closed end. Appliances 110 are each manufactured in a shape that conforms to the shape of the working-head formation of tool 100 to which it will be attached, and as shown in phantom in FIG. 22, appliances 110 may be positioned on tool 100 by sliding them over formations 104 and 106. As will be evident, appliances 110 encircle and enclose the native working-head formations of tool 100 to which they are attached, and temporarily provide an alternative media-engaging working-head formation which modifies the working properties and characteristics of the tool and expands its media range, in the same fashion as disclosed hereinabove. At any time after such use, however, these appliances may be removed, thereby allowing formations 104 and 106 to be used once again in the usual fashion, thus restoring the native media-engaging working-head formations of modeling tool 100. It will be understood by those skilled in the art that the modeling tool 100 shown in the drawings is for illustrative purposes only, and that such tools are widely available in an array of shapes and sizes, and with a variety of different working-head formations. Moreover, this embodiment of the invention is applicable to other tools as well, including, for example, blending tools such as traditional artists' stumps and tortillons.

Any of the appliances manufactured in accordance with the present invention may optionally include an inner lining consisting of a material that is relatively impermeable to the transmission of fluids. In this manner, the native media-engaging working-head formations of the underlying tools may be protected from any liquid medium which is being applied or manipulated by the overlying appliance, or with which that appliance is in contact, and for which the native media-engaging working-head formations are not otherwise ordinarily suited. Those persons skilled in the art will realize that numerous means exist to provide such a fluid-impermeable barrier material, including but not limited to, providing gauze having such a barrier formed on one side, or providing a fluid-absorbent material impregnated with a fluid-impermeable substance, or bonding a thermoplastic sheet to a fluid-absorbent surface, etc.

While there has been described what are at present considered to be the preferred embodiments of the present invention, it will be apparent to those skilled in the art that the embodiments described herein are by way of illustration and not of limitation, and that various changes and modifications may be made therein without departing from the true spirit and scope of the present invention, as set forth in the appended claims.

The invention claimed is:

1. An artist kit, the kit comprising:

a plurality of palette knives, each palette knife including— an elongate shaft, and a solid, flexible blade disposed at an end of said elongate shaft, the blade presenting a blade shape, wherein a blade shape of a palette knife of the plurality of palette knives is unique to other blade shapes in the plurality of palette knives; and a plurality of appliances, each appliance being formed from two sheets of material bonded together to form an enclosure with an open end and a closed end, and presenting side seams, wherein each appliance of the plurality of appliances is shaped and sized to conform substantially to a shape and size of a corresponding blade of a palette knife of the plurality of palette knives such that the appliance is removably attachable to the blade and superimposable over at least a portion of the blade.

2. The kit of claim 1, wherein each palette knife further comprises a handle element disposed at a proximal end of the elongate shaft, wherein the blade is disposed at a distal end of the elongate shaft, and wherein the corresponding appliance is removably attachable to the distal end of the shaft over at least a portion of the blade.

3. The kit of claim 1, wherein each appliance comprises one or more materials selected from the group consisting of polymeric open and closed cellular foams, flocked sponges and foams, synthetic and natural non-foam polymers, micro fibers, synthetic and natural hides, and woven and non-woven fibrous materials.

4. The kit of claim 3, wherein each appliance comprises a cellular foam formed from one or more materials selected from the group consisting of natural and synthetic elastomeric and non-elastomeric polymers.

5. The kit of claim 4, wherein each appliance comprises one or more materials selected from the group consisting of polyurethane foams, nitrile butadiene rubbers and styrene butadiene rubbers.

6. The kit of claim 1 wherein each appliance further comprises a fluid-impermeable material disposed adjacent said corresponding blade when attached to the palette knife.

7. The kit of claim 1, wherein each appliance is sized slightly smaller than the corresponding blade to provide a friction fit when placed on the blade.

* * * * *

UNITED STATES PATENT AND TRADEMARK OFFICE

CERTIFICATE OF CORRECTION

PATENT NO. : 8,250,701 B1
APPLICATION NO. : 12/878706
DATED : August 28, 2012
INVENTOR(S) : Forsline et al.

It is certified that error appears in the above-identified patent and that said Letters Patent is hereby corrected as shown below:

In the Specifications

Column 1, Line 18:
Delete "craftsperson" and insert --craftpersons--.

Column 1, Line 52:
Delete "craftsperson" and insert --craftpersons--.

Column 2, Line 38:
Delete "craftsperson" and insert --craftpersons--.

Column 3, Line 46:
After "FIG. 1 is" delete "a".

Column 9, Line 54:
Delete "craftsperson" and insert --craftpersons--.

Signed and Sealed this
Seventeenth Day of December, 2013

Margaret A. Focarino

Margaret A. Focarino
*Commissioner for Patents of the United States Patent and Trademark Office*